US006113359A

United States Patent [19]

Watts et al.

[11] Patent Number: 6,113,359

[45] Date of Patent: Sep. 5, 2000

[54] AXIAL PISTON PUMP AND RELIEVED VALVE PLATE THEREFOR

[75] Inventors: Thomas A. Watts; John B. Thompson, both of Greenwood, S.C.

[73] Assignee: Eaton Corporation, Cleveland, Ohio

[21] Appl. No.: 09/338,479

[22] Filed: Jun. 22, 1999

[51] Int. Cl.[7] ..... F04B 1/12

[52] U.S. Cl. ..... 417/269; 92/71; 251/283

[58] Field of Search ..... 417/269; 92/71; 251/283

[56] References Cited

U.S. PATENT DOCUMENTS

| | | | |
|---|---|---|---|
| 1,210,649 | 1/1917 | Holley | 417/269 |
| 2,733,666 | 2/1956 | Poulus | 103/162 |
| 3,139,038 | 6/1964 | Stewart | 103/162 |
| 3,274,947 | 9/1966 | Jonkers et al. | 103/162 |
| 4,557,227 | 12/1985 | Woodard | 123/65 PE |
| 5,267,839 | 12/1993 | Kimura et al. | 417/269 |
| 5,307,731 | 5/1994 | Chamberlain et al. | 92/147 |
| 5,429,154 | 7/1995 | Kato | 137/625.65 |
| 5,538,401 | 7/1996 | Schaffner et al. | 417/222 |
| 5,655,432 | 8/1997 | Wilkosz et al. | 92/71 |
| 5,782,613 | 7/1998 | Michiyuki et al. | 417/269 |

FOREIGN PATENT DOCUMENTS

| | | | |
|---|---|---|---|
| 61-167180 | 1/1985 | Japan | 417/269 |

*Primary Examiner*—Timothy S. Thorpe
*Assistant Examiner*—Timothy P Solak
*Attorney, Agent, or Firm*—L. J. Kasper

[57] ABSTRACT

A hydraulic unit including a housing (10,11,13) within which is disposed a rotating cylinder barrel (25) driven by an input shaft (21). The housing means includes an end cap (13) disposed adjacent the end (45) of the cylinder barrel, with a valve plate (39) being disposed intermediate the of the barrel and an interior surface (65) of the end cap (13). The end cap defines a kidney port (59), a high pressure port (63), and a passage (61) interconnecting the kidney port and the high pressure port. In a configuration of the end cap which makes the pump compact, high pressure in the passage can cause deformation of a portion (69) of the end cap. To accommodate such deformation, the valve plate (39) is provided with a relieved area (71) disposed immediately adjacent the deformation portion (69). As a result, such that the deformation doesn't cause any deflection of the valve plate, and therefore, doesn't squeeze out the fluid layer between the valve plate valve surface (43) and the end (45) of the cylinder barrel (25).

6 Claims, 3 Drawing Sheets

AXIAL PISTON PUMP AND RELIEVED VALVE PLATE THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to rotary fluid pressure units, including both pumps and motors, and more particularly, to such pumps and motors of the axial piston type.

In a typical axial piston pump or motor, there is a rotating cylinder barrel which includes a plurality of reciprocating pistons. The pistons engage a cam or swashplate, the position of which may be varied to adjust the displacement of the pump. The end of the cylinder barrel opposite the swashplate is seated against a valve plate which defines a fluid inlet and a fluid outlet. The inlet and outlet are connected, respectively, to the unit inlet port and the unit outlet port defined by the housing (which is sometimes referred to hereinafter as the "end cap").

Although the present invention may be used advantageously in an axial piston motor, it is especially advantageous when used in an axial piston pump, and, partly for ease of reference, will be described in connection therewith.

Axial piston pumps and motors have been widely used commercially for many years in a variety of industrial and mobile applications. One of the benefits of axial piston pumps is their "power density", i.e., the amount of hydraulic power output per unit volume of the pump. In spite of the inherently good power density of axial piston pumps, those skilled in the art continue to try to reduce the physical size of axial piston pumps, and further improve their power density. At the same time, there has been a trend in recent years to operate hydraulic circuits and components at higher and higher pressures, such that axial piston pumps are now routinely expected to be able to generate at least about 4000 to 5000 psi., without substantial degradation of performance or operating life.

However, one disadvantage of the effort to make axial piston pumps more compact, and operate them at higher pressures, is that various portions of the pump become sufficiently thin that, when subjected to such high pressure, those particular portions may deflect to such an extent as to lead to performance and/or durability problems within the pump.

In the conventional axial piston pump, the end cap defines a pair of kidneys, each of which is connected to a port, with a cored fluid passage interconnecting each kidney and port combination. In engagement with an interior surface of the end cap is the valve plate, fixed rotationally relative to the end cap. The end of the cylinder barrel is in sliding engagement with the valve surface of the valve plate as the cylinder barrel rotates. Typically, the valve surface of the valve plate which is in engagement with the cylinder barrel, is treated with a material such as a bronze alloy, to have a hardened surface operating against a hardened surface, and for the purpose of maintaining good wear characteristics between the valve plate and the rotating cylinder barrel.

In an effort to reduce the overall length of the pump, and also to facilitate a "tandem" arrangement of two pumps, it has become customary for the fluid passages in the end cap which interconnect the fluid kidneys and the ports, to be oriented radially relative to an axis of rotation of the pump. However, it has been determined in connection with the development of the subject embodiment of this invention that having at least a portion of the fluid passage oriented radially can result in a deflection or deformation of the portion of the end cap between the fluid passage and the surface adjacent the valve plate. Depending upon the particular configuration of the end cap, such deflection would normally manifest itself as a generally rounded, radially oriented, raised region. In one case, the width of the raised region, in a circumferential direction, was about the width of the adjacent fluid passage, and the resulting axial deformation of the end cap surface was in the range of about 0.000200 inches (0.00508 mm). Although the resulting deformation may seem relatively small, in absolute terms, it is common practice commercially to lap all of the engaging surfaces of the cylinder barrel, the valve plate, and the end cap to a flatness of about 0.000050 inches (0.00127 mm).

As is well known to those skilled in the art, it is intended that the end surface of the cylinder barrel ride on a hydrodynamic layer of oil as the cylinder barrel rotates on the valve plate. It will be understood by those skilled in the art that the term "oil" is used herein in the generic sense to mean and include any of the well know fluids typically used in such axial piston devices. It has been found that, if the interior surface of the end cap deflects, as described above, the result will be a corresponding deformation of the valve plate such that the oil film between the cylinder barrel and the valve plate will be "squeezed out" and metal-to-metal engagement will occur. There are two extremely undesirable results of this metal-to-metal engagement. One is a tendency for the lead in the bronze alloy coating on the valve plate to melt and be "sweated out" of the surface of the bronze coating. In the presence of the heat which is generated, the lead turns black and causes the valve surface of the valve plate to turn black, as though the surface had been "burned". This is primarily an appearance issue, but an important one with many customers.

Another problem is the potential for micro-welding, in which some of the bronze on the valve plate is transferred to the adjacent surface of the cylinder barrel, by means of the heat generated between the relatively rotating surfaces. Eventually, such micro-welding of the bronze destroys the surface finish of the parts, interfering with the generation of the hydrodynamic fluid film, and can destroy either or both of the engaging surfaces, thus substantially reducing the useful operating life of the pump.

BRIEF SUMMARY OF THE INVENTION

Accordingly, it is an object of the present invention to provide an improved hydraulic unit which is designed to overcome the above-described disadvantages of the prior art.

It is a more specific object of the present invention to provide an improved hydraulic unit which is designed such that deflection of a portion of the end cap, caused by high pressure fluid, will not result in deformation of the valve plate and of the various operating problems associated therewith.

The above and other objects of the invention are accomplished by the provision of a hydraulic unit of the type including housing means, a shaft rotatably supported relative to the housing means, a cylinder block rotatably disposed within the housing means and associated with the shaft for rotation therewith. The cylinder block defines an output end and a plurality N of cylinders, and a piston member disposed for reciprocation within each of the cylinders, in response to rotation of the cylinder block. The housing means includes an end cap disposed axially adjacent the output end of the cylinder block, and defining a transverse interior surface, the end cap also defining a first fluid kidney port opening into the interior surface, a high pressure port, and a first fluid passage providing open fluid communication between the first kidney port and the high pressure port. The first fluid passage is configured such that high pressure fluid in the first fluid passage is operable to deflect the end cap between the passage and the interior surface of the end cap. A valve plate is disposed intermediate the cylinder barrel and the end cap and is fixed to be non-rotatable relative to the end cap. The valve plate includes a valve surface in sliding engagement with the output end of the cylinder barrel, and an opposite surface in engagement with the interior surface of the end cap. The valve plate further includes port means configured to provide fluid communication of pressurized fluid between the cylinders and the first kidney port as the cylinder barrel rotates.

The improved hydraulic unit is characterized by the interior surface of the end cap and the opposite surface of the valve plate cooperating to define a relieved area. The deflection of the end cap has a generally known transverse extent and a generally known axial extent. The relieved area is configured such that the known transverse and axial extend of the end cap deflection will not result in any substantial deformation of the valve plate, i.e., in a direction toward the cylinder barrel.

DETAILED DESCRIPTION OF THE PREFERRED EMBODIMENT

Figure 1:
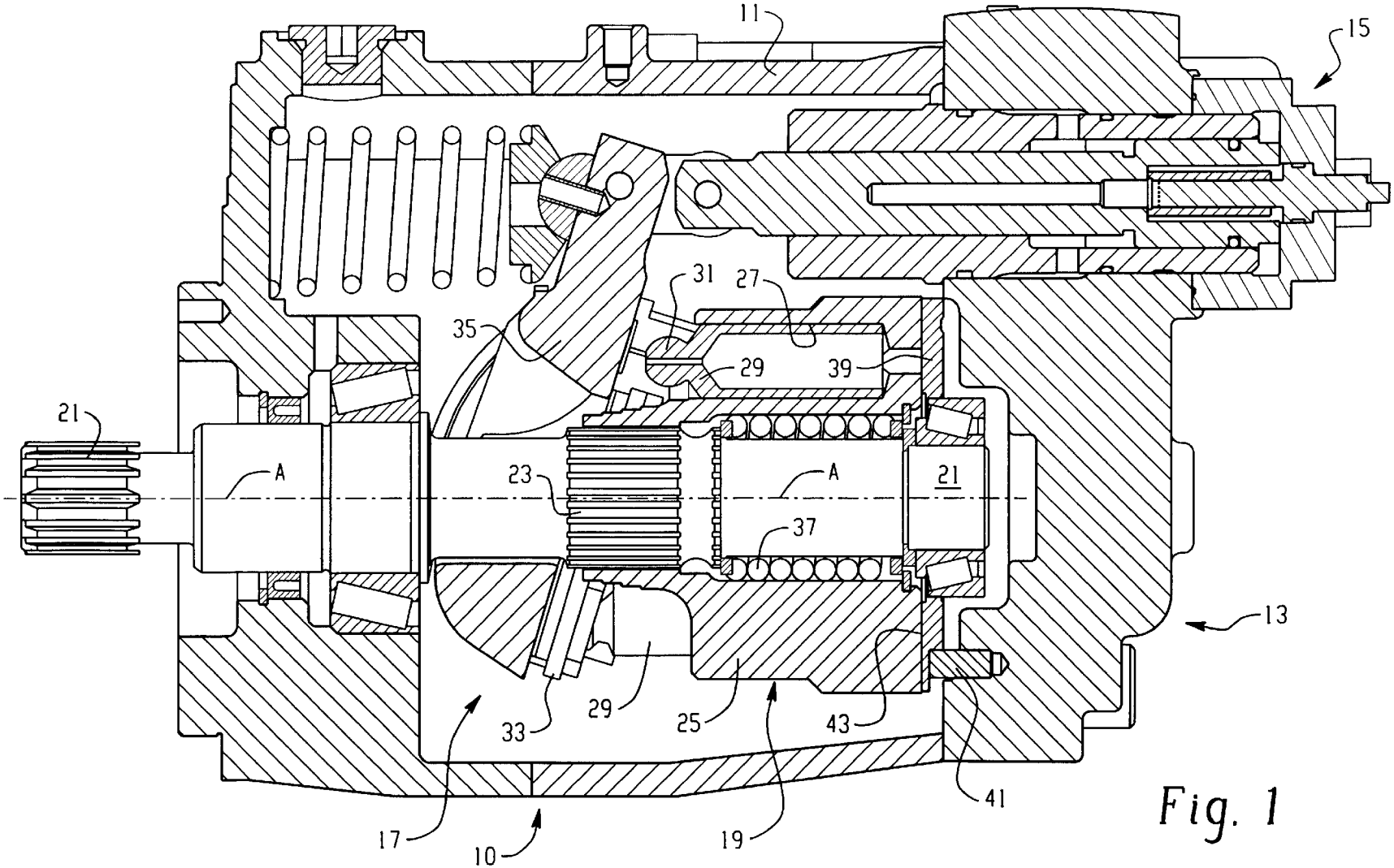
FIG. 1 is an axial cross-section of a conventional axial piston pump of the type with which the present invention may be utilized.

Referring now to the drawings, which are not intended to limit the invention, FIG. 1 is an axial cross-section of an axial piston pump of the general type illustrated and described in great detail in U.S. Pat. No. 4,041,703, assigned to the assignee of the present invention and incorporated herein by reference. The axial piston pump includes a housing assembly, generally designated 10, comprising a main housing 11, a back plate (end cap) assembly 13, and a pump displacement control section, generally designated 15. The main housing 11 cooperates with the end cap 13 to define a pumping chamber 17, within which is disposed a rotating group (pumping element), generally designated 19.

The rotating group 19 receives input torque from an input shaft 21, which extends through nearly the entire axial length of the pump. The input shaft is suitably supported for rotation relative to the main housing 11, and the end cap 13, by various bearing sets, which are conventional and will not be described herein. The subject embodiment of the invention is intended for use in an "open loop" circuit, as that term is well understood by those skilled in the art. However, the present invention is not limited to use in pumps intended for open loop operation, but is equally adapted for use on pumps intended for closed loop operation. At the rearward end of the input shaft 21, the end cap assembly would include a charge pump (not shown herein) of a type well known in the art, if the pump were to be used in a closed loop application.

Disposed within the pumping chamber 17, the input shaft 21 is surrounding by the rotating group 19. The input shaft 21 includes a set of external splines 23, and in splined engagement therewith is a cylinder block or barrel 25, which defines a plurality of axially oriented cylinders 27 (see also FIG. 2). In the subject embodiment, and by way of example only, there are 9 of the cylinders 27. Disposed within each cylinder is an axially reciprocable piston member 29, each of which includes a generally spherical head 31 which is pivotally received by a slipper member 33. The slipper members 33 ride on the surface of a swashplate 35, as the cylinder barrel 25 rotates relative to the rotationally stationary swashplate 35. The input shaft 21 defines an axis of rotation A, and as is well known to those skilled in the art, the swashplate 35 may pivot or tilt about its axis (not shown herein) which is transverse to the axis of rotation A. The axis of rotation A of the input shaft 21 will also be referred to subsequently as the axis of rotation of various other elements in the pump, such as the cylinder barrel, based on the assumption that all such elements are substantially concentric. As is also well known to those skilled in the art, such movement of the swashplate 35 occurs only in the case of a variable displacement pump or motor. In the case of a fixed displacement pump or motor, the swashplate is permanently fixed relative to the housing assembly 10.

Figure 2:
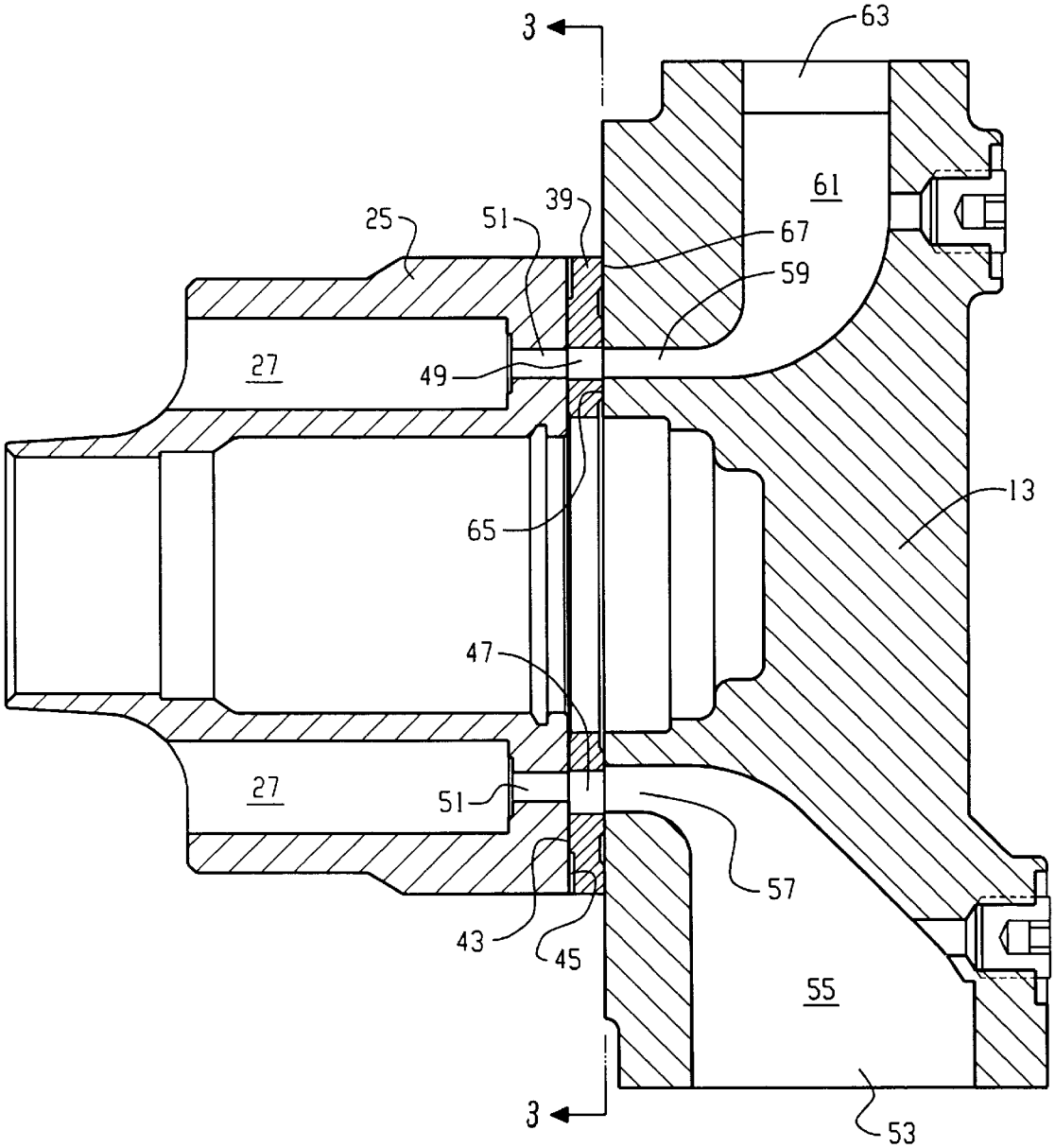
FIG. 2 is an enlarged, axial cross-section, similar to FIG. 1, but showing only those parts of the pump which are directly involved in the present invention.
Figure 3:
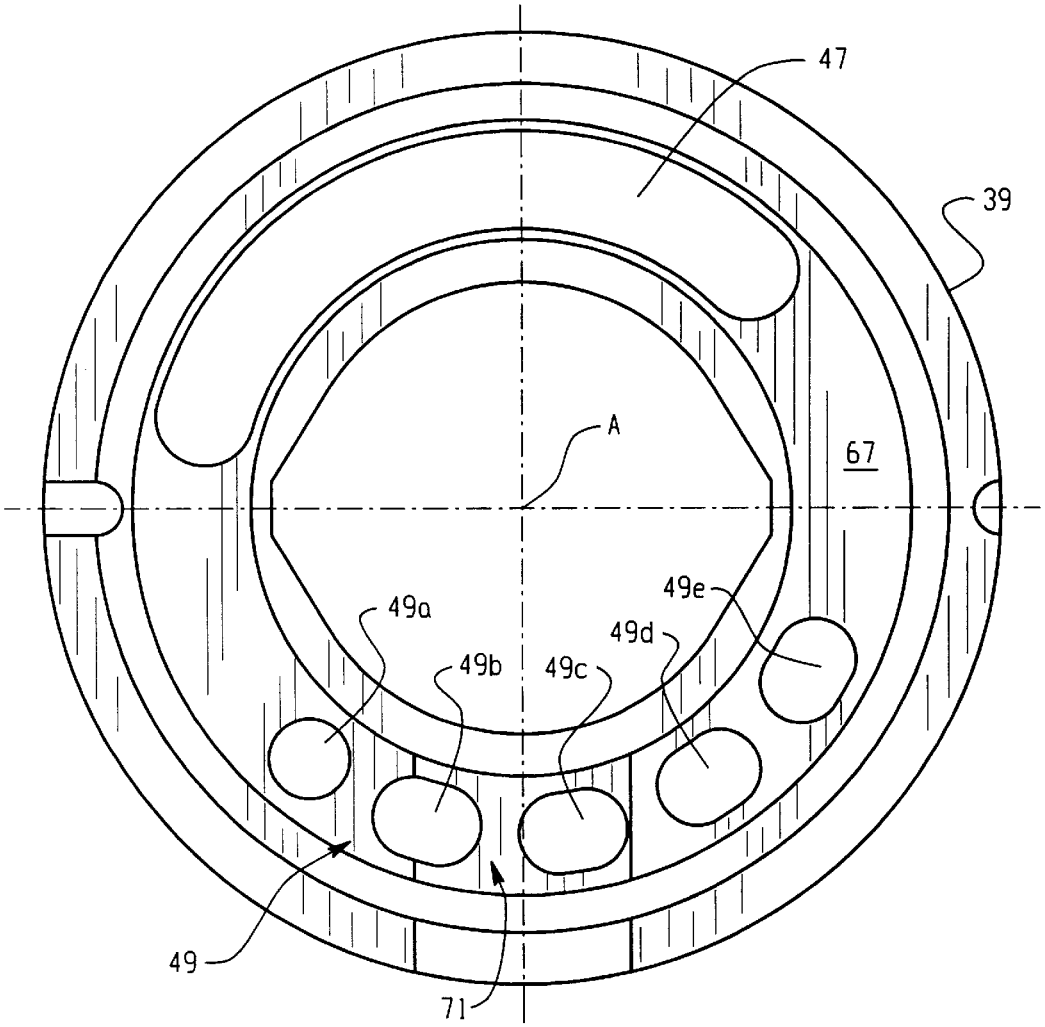
FIG. 3 is a transverse cross-section, taken on line 3—3 of FIG. 2, and on a somewhat larger scale than FIG. 1, illustrating the valve plate made in accordance with the present invention.

The cylinder barrel 25 is biased axially, by means of a spring 37, toward fluid tight engagement with a valve plate 39, which is fixed to be non-rotatable relative to the end cap 13, typically by means of a pin 41 or other suitable means. Referring now also to FIG. 2, and as is well known from commercial axial piston pumps, the valve plate 39 includes a valve surface 43 disposed in sliding, sealing engagement with an end surface 45 of the cylinder barrel 25. The valve plate 39 further defines a fluid inlet 47 and a fluid outlet 49, best shown in FIG. 3. In the subject embodiment, and by way of example only, the fluid outlet 49 actually comprises a plurality of individual, generally kidney-shaped outlets 49*a*, 49*b*, 49*c*, 49*d*, and 49*e*. This illustrated arrangement of individual outlets 49*a* through 49*e* is utilized particularly in high pressure applications, with the solid portions of the valve plate 39 between the individual outlets adding strength to the valve plate. It should be understood, however, that the present invention is not limited to any particular outlet configuration.

Referring still primarily to FIG. 2, in conjunction with FIG. 1, at the rearward end of each of the cylinders 27 (right end in FIGS. 1 and 2), the cylinder barrel 25 defines a cylinder port 51 which, as is well known to those skilled in the art, is typically generally kidney shaped, and as the cylinder barrel 25 rotates, each cylinder port 51 passes over the fluid inlet 47, as fluid is drawn into the respective cylinder 27, then passes over the series of fluid outlets 49*a* through 49*e*, as fluid is pumped out of the respective cylinder.

Referring still primarily to FIG. 2, the end cap 13 will be described in some detail, bearing in mind that the device shown herein is being described as a pump. The end cap 13 defines a low pressure inlet port 53 which communicates fluid by means of a passage 55 to a low pressure inlet kidney-shaped port 57. The valve plate 39 is oriented, relative to the end cap 13, such that the low pressure inlet fluid flows through the inlet kidney-shaped port 57, then through the fluid inlet 47 and then through the cylinder ports 51 into the expanding cylinders 27 (i.e., those in which the piston member 29 is moving to the left in FIG. 1).

At the same time, certain of the cylinders 27 are contracting (i.e., the piston member 29 is moving to the right in FIG. 1), pumping high pressure fluid out of the respective cylinder ports 51, then through the fluid outlet 49 into a high pressure outlet kidney-shaped port 59. High pressure in the kidney-shaped port 59 flows through a passage 61 to a high pressure outlet port 63. The end cap 13 defines an interior surface 65, into which the kidney-shaped ports 57 and 59 open. The valve plate 39 includes a sealing surface 67 (see also FIG. 3), opposite the valve surface 43, and in tight sealing engagement with the interior surface 65 of the end cap 13.

Figure 4:
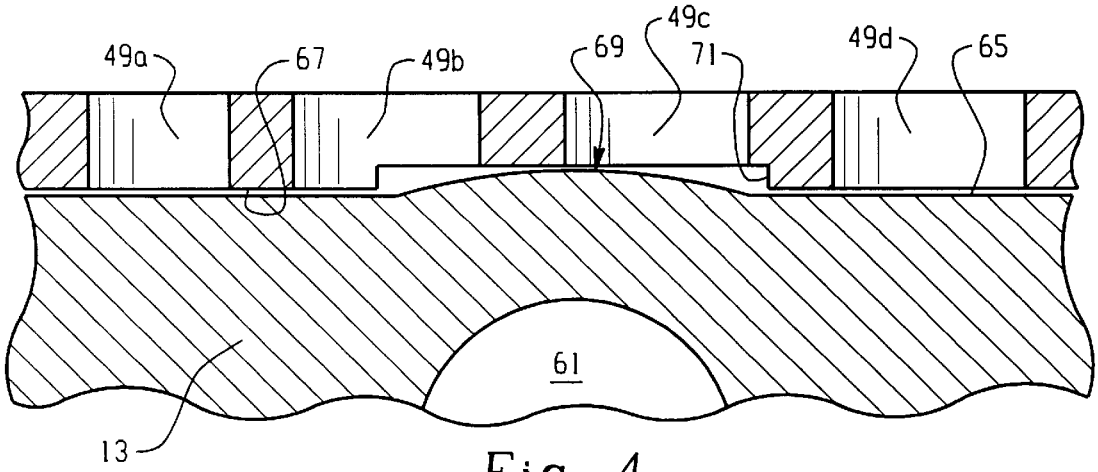
FIG. 4 is a further enlarged, fragmentary, horizontal cross-section through the valve plate and part of the end cap, illustrating the operation of the present invention.

Referring now primarily to FIG. 4, in which certain elements are greatly exaggerated for purposes of illustration, the present invention will be described. In addition, the interior surface 65 and the sealing surface 67 are shown slightly spaced apart, merely for clarity of illustration. As was mentioned in the BACKGROUND OF THE DISCLOSURE, one of the key design criteria is to make the pump as short and compact as possible, thus the radial arrangement of passages 55 and 61 shown in FIG. 2. However, one result of such a compact design is that the portion of the end cap 13 intermediate to the high pressure passage 61 and the interior surface 65, such portion being generally designated 69, is readily deflectable or deformable under the influence of high pressure in the passage 61. By way of example only, "high pressure" in the case of an axial piston unit would typically be a fluid pressure in the range of about 3000 psi or more, and in some cases as much as 8000 psi. However, it will be understood by those skilled in the art that the invention may be used advantageously regardless of what constitutes "high pressure" for a particular pump or a particular application. Clearly, the higher the pressure being pumped, the greater will be the benefit of the present invention.

In the current embodiment, when the passage 61 contains fluid at about 4000 psi, the portion 69 of the end cap 13 will deflect approximately 0.00023 inches (0.00584 mm) from the normal, nominal flat plane of the interior surface 65. It is one important aspect of the present invention that, instead of trying to eliminate such deflection by adding material to the end cap 13, the deflection of the portion 69 adjacent the high pressure passage 61 is instead to be "accommodated", as that term will be explained subsequently.

Such accommodation of the deflection of the portion 69 is accomplished by providing the sealing surface 67 of the valve plate 39 with a relieved area 71. Typically, the relieved area 71 would be formed by means of a grinding and etching operation. If the relieved area is to be ground, the grinding wheel can move along a generally radial path, either toward or away from the axis of rotation A of the valve plate 39. In general, it is an object of the invention to size the relieved area 71 to be large enough so that the deformation portion 69 will not cause a deflection of, or a loading upon, the valve plate 39 while at the same time, to be small enough so that the relieved area 71 does not result in an excessive leakage flow path from high pressure to case.

In making use of the present invention, one of the first steps is to determine the extent, both transversely (in a direction parallel to the surface 65 in FIG. 4) and axially (in a direction normal to the surface 65), of the portion 69 which is deflecting. Although this determination may be made by actually pressurizing an end cap and measuring the extent of the deflection, those skilled in the art will understand that it is preferable to utilize FEA (finite element analysis) techniques. By such techniques, which are now well known and commonly used, the dimensional characteristics of the region of deflection can be readily determined for any given level of pressure in the passage 61.

Once the determination has been made of the extent of the deflection, the relieved area 71 may then be designed/selected such that, as the deflection of the portion 69 of the end cap occurs, there will not be any corresponding deflection or deformation of the valve plate, as was discussed previously. By way of example only, the relieved area 71 may be configured to have a width, in the transverse direction, approximately equal to the diameter of the passage 61. The axial dimension of the relieved area 71 should be approximately equal to the axial extent of the deformation of the portion 69. Alternatively, the axial dimension can be less than the axial extent of the deformation as long as the total non-flatness during operation does not exceed the fluid film thickness.

Although the relieved area 71 is shown as being generally rectangular is cross-section, those skilled in the metalworking art will understand that the cross-section of the relieved area 71 will typically be determined by some factor such as the shape and dressing of a tool such as a grinding wheel.

Although not specifically shown in FIG. 4, for ease of illustration, it should be recognized that the high pressure passage 61 will typically be disposed generally perpendicular to the fluid outlet 49 defined by the valve plate. As a result, the relieved area 71, which is basically aligned with the passage 61, will typically intersect some part of the outlet 49. In the subject embodiment, the relieved are 71 intersects the outlets 49*b* and 49*c*, such that it is desirable for the relieved area 71 to conform generally to the shape of the portion 69, and minimize any leakage which might occur.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic unit of the type including housing means, a shaft rotatably supported relative to said housing means, a cylinder block rotatably disposed within said housing means and associated with said shaft for rotation therewith; said cylinder block defining an output end and a plurality N of cylinders, and a piston member disposed for reciprocation within each of said cylinders, in response to rotation of said cylinder block; said housing means including an end cap disposed axially adjacent said output end of said cylinder bock and including a transverse interior surface and defining a first fluid kidney port opening into said interior surface, a high pressure port, and a first fluid passage providing open fluid communication between said first kidney port and said high pressure port, said first fluid passage being configured such that high pressure fluid in said first fluid passage is operable to deflect a portion of said end cap between said first fluid passage and said interior surface; a valve plate disposed intermediate said cylinder barrel and said end cap and fixed to be non-rotatable relative to said end cap, said valve plate including a valve surface in sliding engagement with said output end of said cylinder barrel, and an opposite surface in engagement with said interior surface of said end cap said valve plate further including port means configured to provide fluid communication of pressurized fluid between said cylinders and said first kidney port as said cylinder barrel rotates; characterized by:

(a) said interior surface of said end cap and said opposite surface of said valve plate cooperating to define a relieved area;

(b) said deflection of said portion of said end cap having a generally known transverse extent and a generally known axial extent; and (c) said relieved area being configured such that said known transverse and axial extent of said end cap deflection will not result in any substantial deformation of said valve plate in a direction toward said cylinder block.

2. A hydraulic unit as claimed in claim 1, characterized by said end cap defining a second fluid kidney port opening into said interior surface, a low pressure port, and a second fluid passage providing open fluid communication between said second kidney port and said low pressure port.

3. A hydraulic unit as claimed in claim 1, characterized by said cylinder barrel defining an axis of rotation and said first fluid passage being oriented generally radially relative to said axis of rotation.

4. A hydraulic unit as claimed in claim 1, characterized by said opposite surface of said valve plate defining said relieved area, at least a portion of said port means intersecting said relieved area.

5. A hydraulic unit as claimed in claim 4, characterized by said port means comprises a plurality of individual, relatively smaller kidney ports, each of which is in open fluid communication with said first kidney port defined by said end cap.

6. A hydraulic unit as claimed in claim 1, characterized by said valve surface of said valve plate includes a surface treatment comprising an alloy of bronze.

* * * * *